US008138060B2

(12) United States Patent
Tsukatani et al.

(10) Patent No.: US 8,138,060 B2
(45) Date of Patent: Mar. 20, 2012

(54) WAFER

(75) Inventors: Toshihiko Tsukatani, Tokyo (JP); Takao Maeda, Tokyo (JP); Junichi Nakayama, Tokyo (JP); Hirofumi Kawazoe, Tokyo (JP); Masaru Konya, Tokyo (JP); Noriaki Hamaya, Tokyo (JP); Hajime Nakano, Tokyo (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 12/258,850

(22) Filed: Oct. 27, 2008

(65) Prior Publication Data

US 2009/0108414 A1 Apr. 30, 2009

(30) Foreign Application Priority Data

Oct. 26, 2007 (JP) ..... 2007-278571
Oct. 26, 2007 (JP) ..... 2007-278597

(51) Int. Cl.
*B32B 27/32* (2006.01)
*B32B 9/04* (2006.01)
*B32B 13/04* (2006.01)
*B32B 9/00* (2006.01)
*B32B 19/00* (2006.01)

(52) U.S. Cl. ..... 438/448; 428/220; 428/446; 428/702

(58) Field of Classification Search ..... 428/701, 428/702, 446, 448

See application file for complete search history.

(56) References Cited

U.S. PATENT DOCUMENTS

| | | | | |
|---|---|---|---|---|
| 6,274,500 | B1 * | 8/2001 | Xuechun et al. | 438/706 |
| 2002/0160189 | A1 * | 10/2002 | Wataya et al. | 428/402 |
| 2004/0110016 | A1 * | 6/2004 | Hamaya et al. | 428/472 |
| 2006/0046450 | A1 * | 3/2006 | Narendar et al. | 438/585 |
| 2006/0060826 | A1 * | 3/2006 | Atanackovic | 252/500 |
| 2006/0110609 | A1 * | 5/2006 | Eaton et al. | 428/446 |

FOREIGN PATENT DOCUMENTS

| | | |
|---|---|---|
| JP | 9-45751 A | 2/1997 |
| JP | 2003-86475 A | 3/2003 |

* cited by examiner

*Primary Examiner* — Jonathan Langman
(74) *Attorney, Agent, or Firm* — Westerman, Hattori, Daniels & Adrian, LLP

(57) ABSTRACT

A wafer has a rare earth oxide layer disposed, typically sprayed, on a substrate. It is useful as a dummy wafer in a plasma etching or deposition system.

8 Claims, 2 Drawing Sheets

WAFER

CROSS-REFERENCE TO RELATED APPLICATION

This non-provisional application claims priority under 35 U.S.C. §119(a) on Patent Application Nos. 2007-278571 and 2007-278597 filed in Japan on Oct. 26, 2007 and Oct. 26, 2007, respectively, the entire contents of which are hereby incorporated by reference.

TECHNICAL FIELD

This invention relates to wafers, typically dummy wafers, which are required to have high resistance to corrosive gases or plasmas thereof during the semiconductor fabrication process, and more particularly, to dummy wafers suitable for use in a halogen gas or plasma atmosphere.

BACKGROUND ART

Semiconductor devices are fabricated through various processes including dry etching and deposition processes, many of which resort to plasma techniques. In the plasma processes, highly reactive, corrosive halogen-based gases such as fluorine or chlorine-based gases are often used for the purposes of etching, deposition and cleaning.

For more efficient semiconductor fabrication, it is desired to increase the operation efficiency of these plasma systems. The operation efficiency of plasma systems can be increased by reducing the downtime of systems, which is achieved, for example, by reducing the frequency of wet cleaning of chamber components.

One means for reducing the frequency of wet cleaning is plasma cleaning. That is, any foreign deposits on the reaction chamber resulting from a dry etching or deposition process are removed by applying a suitable gas plasma to reaction products for decomposition or sublimation thereof, and exhausting the decomposed or sublimated products. The plasma cleaning is effective in reducing the frequency of wet cleaning to some extent. When such plasma cleaning is performed, it is essential to place a dummy wafer within the chamber so as to prevent the lower electrode from being exposed directly to the plasma. Even after the plasma cleaning, it is also necessary to hold the dummy wafer within the chamber for the purpose of positively expelling the particles remaining on the inner wall and other members of the chamber and the cleaning gas.

For consistent fabrication of semiconductor devices, the processing system is desired to keep a stable plasma state. In the plasma system, however, the temperature is unstable because plasma treatment entails heat accumulation so that the system interior undergoes a temperature rise or variation at the initial stage of operation. Thus, at the initial stage of operation, a plasma treatment equivalent to the actual process, which is known as dummy treatment, is carried out on a plurality of dummy wafers for the purpose of minimizing a temperature change and keeping the system temperature stable. The dummy treatment is implemented not only for the purpose of stabilizing the system temperature, but also for the purposes of stabilizing the processing atmosphere and pressure prior to execution of etching treatment on substrates, testing system operation, and cleaning and seasoning (or aging) after cleaning. The dummy treatment is also implemented for determining the process conditions for a lot of substrates.

Since process parameters of the system, especially the etching rate of dry etching process, remain unstable immediately after power-on, dummy treatment is also carried out for the purpose of stabilizing the system performance. Also in this case, it is essential to place a dummy wafer within the chamber so as to prevent the lower electrode from being damaged by the plasma treatment.

Such dummy wafers are required to have high corrosion resistance and strength because they are brought in contact with corrosive gases and plasmas. Dummy wafers are generally made of silicon, quartz or the like.

More rigorous conditions are now employed for achieving the goal of improved productivity. For example, cleaning gases of higher corrosive nature are used to further reduce the cleaning time, rapid heating is used to reduce the heating time, and so on.

While silicon wafers or dummy wafers in the form of silicon wafers having a silicon oxide coating formed thereon and quartz wafers are used in the prior art, they have insufficient resistance to highly corrosive cleaning gases and etching gases and fail to inhibit dusting or contamination. These wafers are susceptible to thickness reduction by the cleaning gases and etching gases.

To solve the above and other problems, dummy wafers of alumina ceramics and dummy wafers of yttria-alumina compound-based ceramics (JP-A 2003-86475) were proposed. Undesirably alumina forms aluminum fluoride particles when contacted with fluorine-based gases such as $SF_6$, $CF_4$, $CHF_3$, $ClF_3$, HF, and $C_2F_8$. Additionally, ceramic wafers of alumina or yttria-alumina compounds are expensive because of many problems including a very long time of sintering, a long time of heating and cooling, low yields, and difficulty of productivity improvement. JP-A 9-45751 also discloses a dummy wafer.

DISCLOSURE OF THE INVENTION

An object of the invention is to provide a dummy wafer having high resistance to extremely corrosive cleaning and etching gases and a long service life in such an environment.

The inventors have found that when a rare earth oxide layer is disposed as an outermost layer on a substrate, typically a silicon substrate, the resulting wafer exhibits high corrosion resistance in a halogen-based gas or halogen-based plasma atmosphere and is suited for use as a dummy wafer.

In a first aspect, the invention provides a wafer comprising a substrate and a rare earth oxide layer disposed on the substrate as an outermost layer.

In a preferred embodiment, the substrate is a silicon substrate. The rare earth oxide layer is preferably formed by heat treating a rare earth precursor in an air oven, said rare earth precursor being selected from the group consisting of rare earth organic complexes, rare earth organic acid salts, and rare earth compound sols. The wafer may further comprise an intermediate layer between the substrate and the rare earth oxide layer. The intermediate layer is typically a silicon dioxide layer.

In a second aspect, the invention provides a wafer comprising a substrate and a sprayed coating of rare earth oxide on the substrate as an outermost layer.

In a preferred embodiment, the substrate is a silicon substrate. The wafer may further comprise at least one intermediate layer between the substrate and the sprayed coating. The intermediate layer is typically a silicon layer.

In both the embodiments, the rare earth element is preferably one or multiple elements selected from the group consisting of Sc, Y, La, Ce, Pr, Nd, Sm, Eu, Gd, Tb, Dy, Ho, Er, Tm, Yb, and Lu. The wafer is often used in a halogen-based gas or plasma atmosphere. The wafer is typically used as a dummy wafer in a semiconductor fabrication process.

BENEFITS OF THE INVENTION

When the wafer of the invention is placed in a plasma etching system or plasma deposition system, it undergoes no or little thickness reduction or particle generation during cleaning or stabilizing operation of the system and the rare earth oxide layer has a high hardness. It has a prolonged lifetime and is useful as a dummy wafer.

DESCRIPTION OF THE PREFERRED EMBODIMENT

Figure 1:
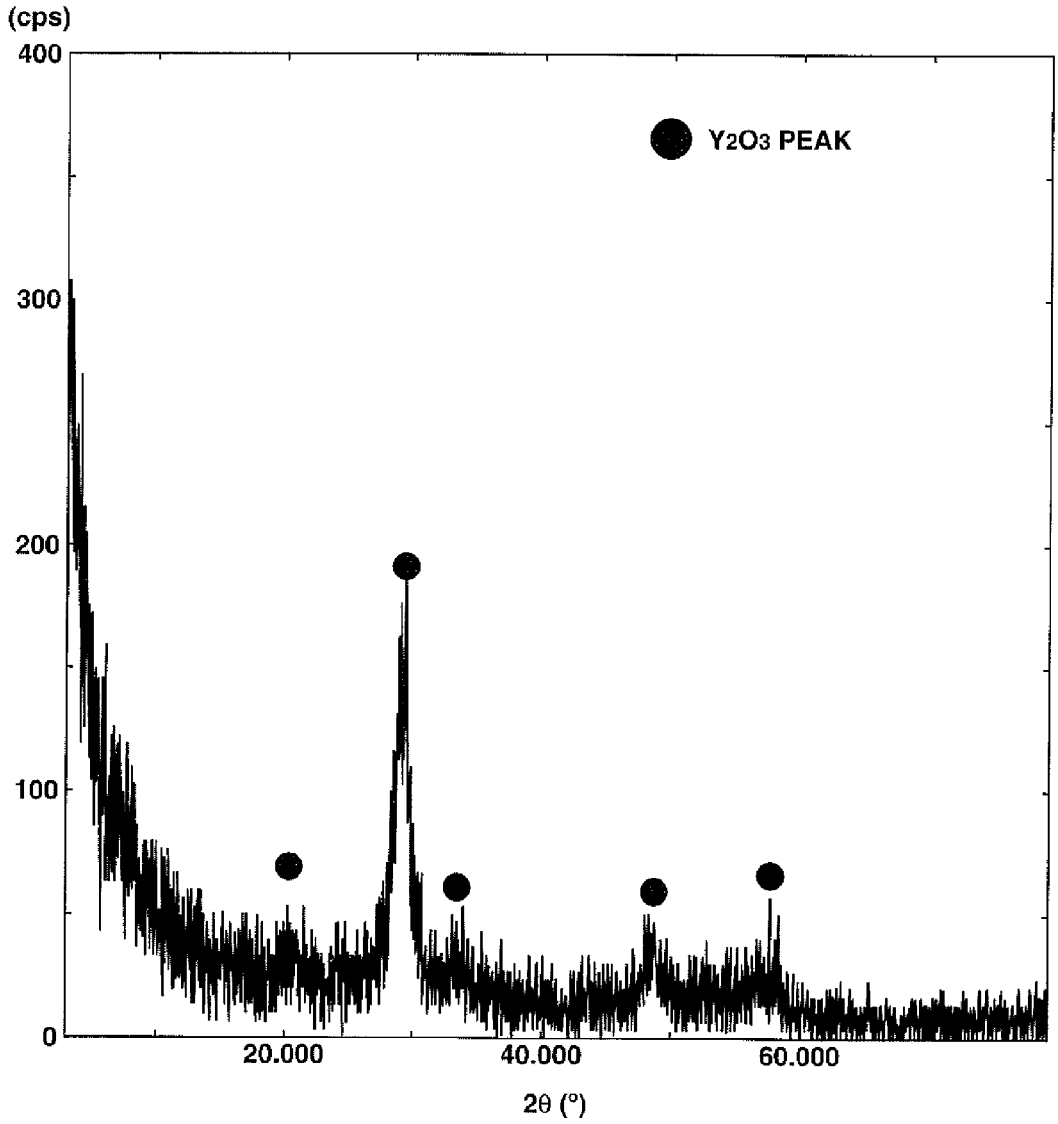
FIG. 1 shows an X-ray diffractometry data of Example 1.

The substrate used herein may be selected from semiconductor substrates such as silicon (Si), silicon carbide (SiC), gallium phosphide (GaP), gallium arsenide phosphide (GaAsP), gallium aluminum arsenide (GaAlAs), gallium nitride (GaN), and ceramic substrates such as alumina ceramics, alumina-based ceramics and quartz. The invention is characterized by a corrosion resistant layer disposed on such a substrate, typically a silicon substrate. The thickness of the substrate is specifically about 0.2 mm to about 1.5 mm though the size and thickness thereof are not particularly limited.

The wafer, specifically dummy wafer, of the invention has a rare earth oxide layer disposed on a substrate, typically a silicon substrate. The layer preferably has a thickness of 1 nm to 1,000 μm, more preferably 10 nm to 100 μm, and even more preferably 10 μm to 50 μm.

In another embodiment wherein thermal spraying is utilized, and hence the wafer, specifically dummy wafer, has a rare earth oxide coating sprayed on a silicon substrate, it is recommended that the sprayed coating have a thickness of 1 to 2,000 μm, and more preferably 10 to 1,000 μm. Thermal spraying is generally used although a coating of equivalent corrosion resistance may be deposited by a cold spraying method.

The rare earth oxide comprises one or multiple rare earth elements selected from the group consisting of Sc, Y, La, Ce, Pr, Nd, Sm, Eu, Gd, Tb, Dy, Ho, Er, Tm, Yb, and Lu.

Even when an intermediate layer, specifically a thermally oxidized film, and more specifically a silicon dioxide layer has been formed on a substrate, typically a silicon substrate, the corrosion resistant rare earth oxide layer may be deposited thereon. The thickness of the intermediate layer is preferably 1 nm to 10 μm, though not particularly limited thereto.

The rare earth oxide layer may be formed by a suitable method, for example, by applying a rare earth precursor solution onto a wafer by spin coating, dip coating, spray coating or the like, drying and heat treatment in an air oven. The rare earth precursor capable of forming an oxide layer may be any of rare earth organic complexes, rare earth organic acid salts, and rare earth compound sols as long as they can be coated in solution form. Exemplary rare earth organic acid salts include rare earth salts of naphthenic acid, octylic acid, stearic acid, acetic acid and the like. Exemplary rare earth organic complexes include acetylacetonato complexes and cyclopentadienyl complexes. Exemplary rare earth compound sols include oxide sols and hydroxide sols. Inter alia, rare earth organic complexes are preferred.

After the rare earth precursor solution is coated onto a substrate, it is dried and heat treated in an air oven for 30 minutes to 5 hours. The temperature of heat treatment is preferably 300 to 1,200° C., and more preferably 500 to 1,200° C.

In general, rare earth oxide layers may be formed on substrates by various deposition methods including physical vapor phase deposition methods such as resistance heating evaporation, electron beam heating evaporation, molecular beam epitaxy, sputtering, ion plating, and ion beam deposition and chemical vapor phase deposition methods in which a film is deposited through vapor phase chemical reaction. Although these methods may be used in the practice of the invention, the apparatus used in these methods are expensive and add to the fabrication cost. The solution coating method described above is inexpensive in terms of installation investment as compared with the physical and chemical vapor phase deposition methods. Additionally, substantially nonporous coatings as thick as 100 μm can be easily formed by the solution coating method.

The rare earth oxide coating may be formed independent of whether the wafer shape is of orientation flat type or notch type.

One embodiment of the invention is described. The coating material may be selected from rare earth organic complexes, rare earth organic acid salts, and rare earth compound sols as described above. These compounds are dissolved in solvents to form solutions, which are then coated. A solution of a rare earth compound may be prepared by dissolving the rare earth compound in a suitable solvent. The solvent used herein is not particularly limited as long as the rare earth compound is dissolvable therein and the object of the invention is attainable. Suitable solvents are, but not limited to, alcoholic solvents including mono-ols such as methanol, ethanol, propanol, butanol, pentanol, 2-methoxyethanol, 2-ethoxyethanol, 2-methoxyethoxyethanol, methoxypropanol, and glycols such as ethylene glycol, propylene glycol and diethylene glycol. A mixture of two or more solvents is also acceptable. The rare earth compound used may have a rare earth purity of at least 90%, preferably at least 99%, and more preferably at least 99.9%. The rare earth compound solution may have a concentration of 0.001 to 1 mol/L, and preferably 0.01 to 0.5 mol/L of rare earth element.

The rare earth compound solution is coated on one surface of a substrate by a spin coater, for example. The number of revolutions is not particularly limited as long as the solution is uniformed coated. Often, spin coating is performed at 10 to 10,000 rpm, followed by drying or heat treatment. Thereafter, if necessary, the rare earth compound solution may be coated on the opposite surface of the substrate for 10 seconds to 1 hour and dried and heat treated for 30 minutes to 5 hours. Then the rare earth oxide layer is formed on either surface of the substrate. The double side coating is effective where a thickness reduction on the bevel back surface of the wafer is a problem. When the rare earth compound solution is coated on the substrate, a portion thereof remains on the substrate surface, but the remaining portion spills off and accumulates in the coating chamber, which may be subsequently recovered for reuse.

In an embodiment wherein both surfaces of a substrate are simultaneously coated, dip coating may be employed. The substrate may be dipped in the rare earth compound solution, preferably at room temperature for 30 seconds to 1 hour. The rare earth compound-coated substrate may then be dried at a temperature between room temperature and the boiling point of the solvent.

Next, the rare earth compound layer is converted into an oxide layer by heat treatment in an air oven at a temperature of 300 to 1,200° C., preferably 500 to 1,200° C., for a time of 10 minutes to 5 hours, depending on the layer thickness. A wafer having a rare earth oxide layer on its surface is obtained. Temperatures below 300° C. achieve insufficient decomposition of the rare earth compound, failing in complete conversion to oxide. Since the melting point of silicon is 1,410° C., heat treatment at temperatures above 1,200° C. is undesirable.

The hardness of the rare earth oxide layer is about 2 to 50 GPa.

Alternatively, the rare earth oxide layer may be formed by thermal spraying.

The thermal spraying method is described in detail. When it is desired to spray a rare earth oxide layer on a substrate, pretreatments, for example, roughening by air blasting techniques using alumina, silicon carbide, zircon, glass beads, quartz or the like, and roughening by wet techniques using etchants based on a mixed acid of hydrofluoric acid and nitric acid fail to provide a surface state sufficient to deposit a rare earth oxide coating thereon. It is then difficult to spray a rare earth oxide layer directly on a silicon substrate. The inventors have found that if a silicon layer is formed on a substrate as a bond coat layer, then a rare earth oxide layer can be deposited on the substrate as an outermost layer. The silicon bond coat layer may be formed by roughening a silicon substrate by air blasting, acid treatment or the like, and presents a sufficient surface roughness to adhesively bond a rare earth oxide layer.

It is not critical how to form the bond coat layer. Chemical vapor deposition (CVD), sputtering, and thermal spraying methods may be used, with the thermal spraying being preferred. The bond coat layer may have a thickness of about 1 μm to about 100 μm.

Then a rare earth oxide layer may be formed by a thermal spraying method. The thermal spraying method may be performed in any atmospheres and include air spraying, controlled atmosphere spraying, low pressure spraying and the like. While the distance between the spray nozzle and the substrate and the traverse speed of the spray gun are controlled, a source powder is fed from a source powder feeder to the gun until the deposit builds up to a desired thickness. The sprayed material may be deposited to a desired thickness by controlling the traverse speed of the spray gun, the feed rate of source powder, and the number of repeated deposition passes. The coating may be easily deposited as thick as 2 mm.

In general, rare earth oxide layers may be formed on substrates by various deposition methods including physical vapor phase deposition methods such as sputtering, evaporation and ion plating, and chemical vapor phase deposition methods such as plasma-enhanced CVD and pyrolytic CVD. When the feature of the invention that the rare earth oxide layer is relatively thick, specifically 1 μm or more is taken into account, the physical and chemical vapor phase deposition methods are uneconomical because of a length of time taken until the desired thickness is reached. The apparatus used in these methods are expensive as well. These factors add to the manufacture cost.

It is recommended from these considerations that a thermal spraying method capable of deposition to a buildup of 1 to 2,000 μm within a relatively short time be employed in the practice of the invention.

The sprayed rare earth oxide coating may be formed independent of whether the wafer shape is of orientation flat type or notch type, while it is not limited by the diameter of wafer as well.

A further embodiment of the invention is described. The starting wafer serving as a substrate is preferably pretreated to roughen its surface to increase its receptivity to a bond coat layer, typically a sprayed silicon coating. Suitable roughening treatments include air blasting using abrasives of alumina, silicon carbide, zircon, glass beads, quartz or the like, and wet treatment with etchants based on a mixed acid of hydrofluoric acid (HF) and nitric acid ($HNO_3$). The roughening treatment is not particularly limited as long as the adhesive bonding (or receptivity) to a subsequently sprayed coating is fully enhanced. In the case of air blasting, an air pressure of 0.01 to 0.2 MPa is preferred for preventing the wafer edge from chipping away. An air pressure in excess of 0.2 MPa may cause chipping of the wafer edge. After the roughening treatment, the substrate preferably has a surface roughness Ra of 0.5 to 5 μm according to the JIS standard.

The bond coat layer is preferably of the same material as the substrate or another coating layer from the standpoint of avoiding entry of any foreign matter as an impurity source into the plasma process chamber. For a silicon substrate, a silicon bond coat layer is preferably formed. From the above viewpoint, the contents of impurities in the material are desirably as follows: Fe<100 ppm, Al<500 ppm, Ca<100 ppm, Ni<50 ppm, Cr<50 ppm, Zr<50 ppm, Na<50 ppm, and k<50 ppm. The bond coat layer is preferably formed by a spraying technique, which can form a layer with a rough surface enough to receive any overlying layer in tight bond. The bond coat layer preferably has a surface roughness Ra of 1 to 10 μm. The bond coat layer may have any suitable thickness to provide a surface roughness in the range. The formation of a bond coat layer having a surface roughness Ra of 1 to 10 μm facilitates subsequent deposition of a rare earth oxide coating thereon.

When a spray coating is formed on a wafer, the wafer may be warped due to shrinkage of the coating layer. In this case, the problem can be solved by air blasting the wafer before conducting a spray technique. When a wafer having mirror-like surface is air blasted, the blasted surface becomes protrudent due to plastic deformation. By laminating a spray coating on the warped or protrudent wafer, the warpage is revised by shrinkage stress.

Then the rare earth oxide coating may be formed on either one surface or both surfaces of the substrate by air spraying, controlled atmosphere spraying, low pressure spraying or the like. In case that the wafer is chuck by an electrostatic chuck, it is preferable to form the rare earth oxide coating by a spray technique on one surface (an upper surface) of the wafer, thereby imparting corrosion resistance without impairing dechuck property. The rare earth oxide coating preferably has a thickness of 1 to 2,000 μm, and more preferably 10 to 1,000 μm. Coatings of less than 1 μm are difficult to deposit whereas coatings in excess of 2,000 μm may give rise to the problem of interference with the gate or wafer inlet/outlet port of the plasma processing vessel.

The hardness of the rare earth oxide spray layer is about 2 to 30 GPa.

The resulting wafer having a rare earth oxide layer formed thereon is desirably controlled to have the same thickness as semiconductor wafers because the wafer is advantageously used as a dummy wafer in the semiconductor fabrication process.

EXAMPLE

Examples of the invention are given below by way of illustration and not by way of limitation.

Example 1

Using a spin coater MS-A200 (Mikasa Co., Ltd.), an ethanol solution of 0.45 mol/L acetylacetonatoyttrium was spin coated to a mirror surface of an orientation flat type 8-inch silicon substrate (725 μm thick). A shot of coating dispensed a volume of 1 mL, and the substrate was spun at 500 rpm for 5 seconds, then at an increased speed of 2,000 rpm for 30 seconds. The solvent, ethanol volatilizes during spinning. At the end of spin coating, a dry acetylacetonatoyttrium thin film was formed. The foregoing operation was repeated 30 times. Thereafter, the acetylacetonatoyttrium-coated silicon wafer was heat treated in an air oven at 500° C. for 2 hours while heating and cooling the oven at a rate of 100° C./hour. The wafer as heat treated was analyzed by thin-film x-ray diffractometry using analyzer RINT-1200 (Rigaku Corp.) with a thin-film attachment (Cat 2850B1). A peak corresponding to yttrium oxide was observed.

FIG. 1 shows the X-ray diffractometry data. The thickness of the coating film was 1.03 μm by the measurement using F20 Thin-Film Measurement Systems available from Filmetrics, Inc. The surface roughness Ra of the coating film was 0.5 nm by the measurement using Dektak 3ST available from Veeco Instruments Corp. The hardness of the coating film was 6.1 GPa by the measurement using SMT-7 available from Matsuzawa Co., Ltd.

A portion of the wafer was masked with polyimide tape before it was subjected to a plasma etching test. The etching test run on an etching system PD-2S (Samco Inc.) at 20 mL/min of $CF_4$, 5 mL/min of $O_2$ a chamber inner pressure of 40 Pa and a power of 50 W for one hour. At the end of the etching test, the polyimide masking tape was stripped off. The wafer was measured by Dektak 3ST available from Veeco Instruments Corp., finding that the step between the masked and exposed sections was not recognized. The result is shown in Table 1.

Example 2

An oxide layer was formed on a silicon substrate by the same procedure as in Example 1 except that the heat treatment was at 1,000° C. The wafer was examined by the same test, with the result shown in Table 1. The formation of Si oxide layer was confirmed by EPMA.

Examples 3 to 11

Oxide layers were formed on silicon substrates by the same procedure as in Example 1 except that ethanol solutions of 0.45 mol/L rare earth acetylacetonato salts were used. The wafers were examined by the same test, with the results shown in Table 1.

The hardness of the oxide layers of Examples 2 to 11 was within the range of 5 to 20 GPa.

Comparative Example 1

A silicon substrate with mirror finish was partly masked with polyimide tape and then subjected to the same plasma etching test as in Example 1. The step on the test piece was observed as in Example 1, finding that the exposed section was etched to a depth of 12 μm. The surface roughness Ra was 1.0 nm and the hardness was 11.0 GPa.

Comparative Example 2

A 8-inch alumina substrate of 725 μm thick was partly masked with polyimide tape and then subjected to the same plasma etching test as in Example 1. The step on the test piece was observed as in Example 1, finding that the exposed section was etched to a depth of 4.9 μm. The surface roughness Ra was 15 nm and the hardness was 18.0 GPa.

TABLE 1

| Acetylacetonato salt | Etch depth (μm) |
|---|---|
| Example 1 (Y, yttrium) | <0.1 |
| Example 2 (Y, yttrium) | <0.1 |
| Example 3 (Sc, scandium) | <0.1 |
| Example 4 (Gd, gadolinium) | <0.1 |
| Example 5 (Tb, terbium) | <0.1 |
| Example 6 (Dy, dysprosium) | <0.1 |
| Example 7 (Ho, holmium) | <0.1 |
| Example 8 (Er, erbium) | <0.1 |
| Example 9 (Tm, thulium) | <0.1 |
| Example 10 (Yb, ytterbium) | <0.1 |
| Example 11 (Lu, lutetium) | <0.1 |
| Comparative Example 1 | 12 |
| Comparative Example 2 | 4.9 |

Example 12

A 8-inch silicon substrate of 725 μm thick was roughened by air blasting of alumina abrasive grits having an average particle size of 100 μm under a pressure of 0.03 MPa. The silicon substrate as blasted had a surface roughness Ra of 1.0 μm. A bond coat layer was then deposited on the silicon wafer by means of an air plasma spraying apparatus which was fed with a silicon powder with an average particle size of 30 μm and argon gas as the plasma gas, and operated at a power of 40 kW, a spraying distance of 120 mm and a deposition rate of 5 μm/pass. The silicon layer was deposited to a thickness of 10 μm. The sprayed silicon layer had a surface roughness Ra of 2.1 μm when measured by a surface roughness meter E-35 A (Tokyo Seimitsu Co., Ltd.). The silicon layer was confirmed by EPMA.

The amounts of impurities in the silicon powder were measured by ICP emission spectrometry (inductivity coupled plasma). The results are as follows.

| | |
|---|---|
| Fe: | 25 ppm |
| Al: | 280 ppm |
| Ca: | 22 ppm |
| Ni: | <5 ppm |
| Cr: | <2 ppm |
| Zr: | <5 ppm |
| Na: | <5 ppm |
| K: | <5 ppm |

Next, yttrium oxide was sprayed on the silicon layer on the silicon substrate by means of an air plasma spraying apparatus which was fed with a yttrium oxide powder and argon gas as the plasma gas, and operated at a power of 40 kw, a spraying distance of 120 mm and a deposition rate of 20 μm/pass. The yttrium oxide layer deposited had a thickness of 40 μm and a surface roughness Ra of 4.5 μm. The hardness was 5 GPa. The silicon wafer having a corrosion resistant yttrium oxide layer deposited thereon was subject to ultrasonic cleaning in ultra-pure water at 40 kHz and dried at 80° C., whereupon it was ready for use.

Figure 2:
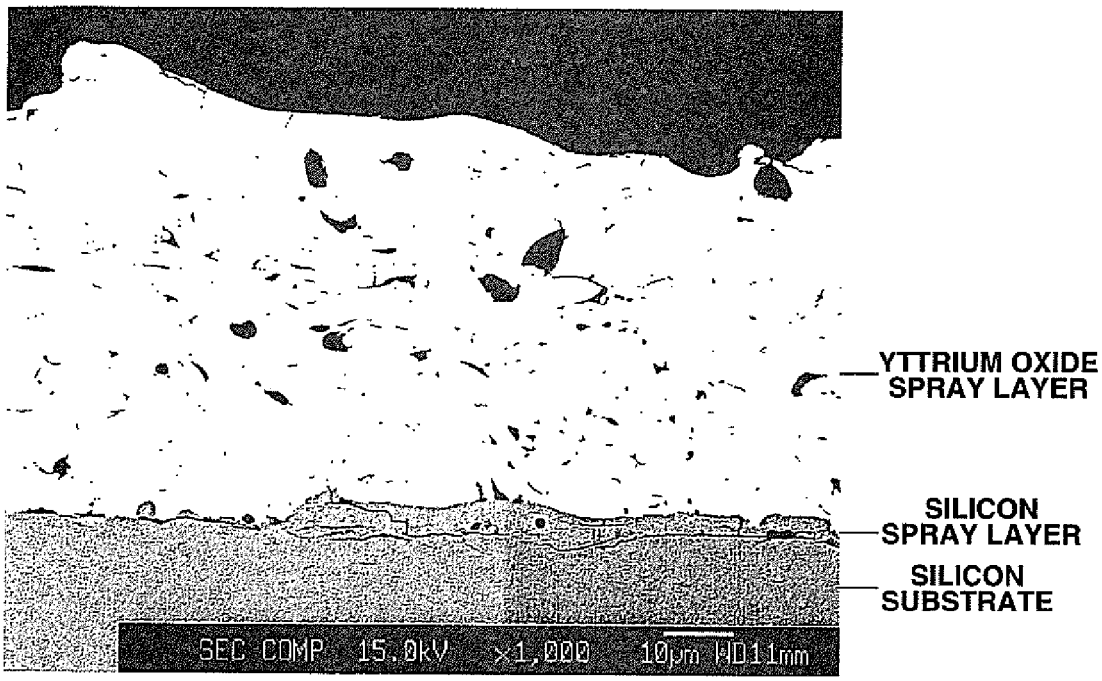
FIG. 2 shows a photograph of a cross-section of wafer in Example 12 by a scanning electron microscope.

FIG. 2 shows a photograph of a cross-section of wafer by a scanning electron microscope (magnification ×1,000).

In order to observe the change of warpage of a wafer, 10 μm of silicon was sprayed on a blasted 8-inch silicon wafer, followed by formation of 40 μm, 60 μm or 80 μm of yttrium oxide spray coating. Warpage was measured as follows.

Figure 3:
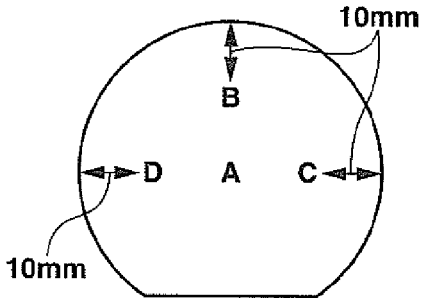
FIG. 3 shows an example of a wafer.

In the wafer shown in FIG. 3, the warpage was obtained by measuring the height at each position A to D using three-dimensional coordinate measuring machine available from TOKYO SEIMITSU CO., LTD. and calculating according to the following equation.

$$\text{Warpage} = H_A - \frac{(H_B + H_C + H_D)}{3}$$

$H_A$ to $H_D$ show the height at positions A to D respectively. In this case, position A is the center of the wafer and positions B to D are the positions at 10 mm apart from the circumference of the wafer toward the center, as is shown in FIG. 3.

The results are shown in Table 2.

TABLE 2

| Sample | Warpage (mm) |
|---|---|
| Non-treated silicon wafer | 0.0039 |
| After blasting | 0.1460 |
| After spraying 10 μm of silicon | 0.0505 |
| After spraying 40 μm of yttrium oxide | −0.0147 |
| After spraying 60 μm of yttrium oxide | −0.0503 |
| After spraying 80 μm of yttrium oxide | −0.0735 |

As is evident from the above results, the formation of 40 μm of yttrium oxide spray coating film can minimize warpage for a 8-inch wafer.

A 20 mm×20 mm piece was cut out of the wafer and surface polished to be flat and smooth. A half section of the corrosion resistant layer was masked with polyimide tape before the piece was subjected to a plasma etching test. The etching test run on an etching system PD-2S (Samco Inc.) at 20 mL/min of $CF_4$, 5 mL/min of $O_2$, a chamber inner pressure of 40 Pa and a power of 50 W for one hour. At the end of the etching test, the polyimide masking tape was stripped off. The test piece was observed under a laser microscope VK-8500 (Keyence Corp.), finding that the step between the masked and exposed sections was below the measurement limit. The result is shown in Table 3.

Examples 13 to 23

By the same procedure as in Example 12, oxide layers were deposited on silicon substrates using various rare earth oxide powders. The resulting wafers were tested as in Example 12, with the results shown in Table 3.

The hardness of the oxide layers of Examples 13 to 23 was within the range of 3 to 15 GPa.

Comparative Example 3

A silicon substrate with mirror finish was roughened by air blasting of alumina abrasive grits having an average particle size of 100 μm under a pressure of 0.2 MPa. The substrate as blasted was found chipped at the edge.

Comparative Example 4

A silicon substrate with mirror finish was roughened by air blasting of alumina abrasive grits having an average particle size of 100 μm under a pressure of 0.03 MPa. The substrate as blasted had a surface roughness Ra of 0.9 μm. A yttrium oxide powder was sprayed on the roughened silicon wafer by means of an air plasma spraying apparatus which was fed with the yttrium oxide powder and argon gas as the plasma gas, and operated at a power of 40 kw, a spraying distance of 120 mm and a deposition rate of 15 μm/pass. No yttrium oxide powder deposited on the silicon wafer.

Comparative Example 5

A silicon substrate with mirror finish was partly masked with polyimide tape and then subjected to the same plasma etching test as in Example 12. The step on the test piece was observed as in Example 12, finding that the exposed section was etched to a depth of 12 μm.

Comparative Example 6

A 8-inch alumina substrate of 725 μm thick was partly masked with polyimide tape and then subjected to the same plasma etching test as in Example 12. The step on the test piece was observed as in Example 12, finding that the exposed section was etched to a depth of 4.9 μm.

TABLE 3

| | Etch depth (μm) |
|---|---|
| Example 12 (Y, yttrium) | <0.1 |
| Example 13 (Y, yttrium) | <0.1 |
| Example 14 (Sc, scandium) | <0.1 |
| Example 15 (Ce, cerium) | <0.1 |
| Example 16 (Gd, gadolinium) | <0.1 |
| Example 17 (Tb, terbium) | <0.1 |
| Example 18 (Dy, dysprosium) | <0.1 |
| Example 19 (Ho, holmium) | <0.1 |
| Example 20 (Er, erbium) | <0.1 |
| Example 21 (Tm, thulium) | <0.1 |
| Example 22 (Yb, ytterbium) | <0.1 |
| Example 23 (Lu, lutetium) | <0.1 |
| Comparative Example 3 | No deposit |
| Comparative Example 4 | Deposition impossible |
| Comparative Example 5 | 12 |
| Comparative Example 6 | 4.9 |

Japanese Patent Application Nos. 2007-278571 and are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A wafer consisting of a silicon substrate having a surface roughness RA of 0.5 to 5 μm, a silicon layer formed on the substrate as a bond coat layer and having a surface roughness Ra of 1 to 10 μm, and a sprayed coating of rare earth oxide on the silicon layer as an outermost layer.

2. The wafer of claim 1 wherein the rare earth element is one or multiple elements selected from the group consisting of Sc, Y, La, Ce, Pr, Nd, Sm, Eu, Gd, Tb, Dy, Ho, Er, Tm, Yb, and Lu.

3. The wafer of claim 1, wherein the wafer is used in a halogen-based gas or plasma atmosphere.

4. The wafer of claim 1, wherein the wafer is a dummy wafer in a semiconductor fabrication process.

5. The wafer of claim 1 wherein the rare earth oxide layer is disposed on more than one surface of said substrate.

6. The wafer according to claim 1, wherein the rare earth oxide layer has a hardness of 2 to 50 GPa.

7. The wafer of claim 1, wherein the rare earth oxide layer is sprayed by a thermal spraying method.

8. The wafer of claim 1 wherein the silicon layer is a thermal-sprayed silicon layer.

* * * * *